United States Patent [19]

Kawasaki

[11] Patent Number: 4,895,358

[45] Date of Patent: Jan. 23, 1990

[54] NOTE FEEDING DEVICE

[75] Inventor: Kiyoshi Kawasaki, Omihachiman, Japan

[73] Assignee: Omron Tateisi Electronics Co., Kyoto, Japan

[21] Appl. No.: 265,280

[22] Filed: Oct. 25, 1988

Related U.S. Application Data

[63] Continuation of Ser. No. 16,622, Feb. 19, 1987, abandoned.

[30] Foreign Application Priority Data

Feb. 20, 1986 [JP] Japan ..... 61-24033[U]

[51] Int. Cl.[4] ..... B65H 3/52

[52] U.S. Cl. ..... 271/121; 271/149

[58] Field of Search ..... 271/31.1, 121, 124, 271/149, 150

[56] References Cited

U.S. PATENT DOCUMENTS

| | | | |
|---|---|---|---|
| 2,080,968 | 5/1937 | Krell | 271/124 |
| 4,535,981 | 8/1985 | Watanabe | 271/124 X |
| 4,588,182 | 5/1986 | Nakanishi | 271/121 |

FOREIGN PATENT DOCUMENTS

| | | | |
|---|---|---|---|
| 2263468 | 7/1974 | Fed. Rep. of Germany | 271/124 |
| 145946 | 11/1980 | Japan | 271/124 |
| 145948 | 11/1980 | Japan | 271/124 |
| 102444 | 6/1982 | Japan | 271/121 |
| 178136 | 9/1985 | Japan | 271/124 |

*Primary Examiner*—Richard A. Schacher

*Attorney, Agent, or Firm*—Stevens, Davis, Miller & Mosher

[57] ABSTRACT

A note feeding device includes a cartridge for storing notes to be fed out through a feeding portion thereof, a feeding roller disposed at the feeding portion of the cartridge to contact a front surface of the stored notes, a spring plate disposed opposite to said feeding roller with respect to a note dispensed from the cartridge, a reciprocating member supporting the spring plate for reciprocation movement in the direction to contact the feeding roller, and a biassing member for pushing the reciprocating member toward the feeding roller.

1 Claim, 1 Drawing Sheet

NOTE FEEDING DEVICE

This application is a continuation of application Ser. No. 016,622, filed Feb. 19, 1987, now abandoned.

BACKGROUND OF THE INVENTION

1. Field of the Invention

This invention relates to note feeding devices employed in automatic teller machines installed in banks and at other locations in which notes are stored in cartridges and in which a predetermined number of notes are dispensed from the cartridge in accordance with an instruction.

2. Discussion of the Prior Art

Note feeding devices employed in automatic transaction terminals are known in which deposited notes are stored and in which a predetermined number of notes are dispensed in accordance with an entered instruction during a withdrawal transaction. By way of example, FIG. 2 shows such a conventional note feeding device including a note storage cartridge 1 storing notes in which in accordance with a withdrawal instruction the notes stored in the cartridge 1 are fed out one by one.

The conventional note feeding device is so constructed that the stored notes A are biassed by a pressure force F toward a forward feeding out portion of the cartridge 1. A feeding out rubber roller 2 and a feeding out roller 3 are disposed at the forward feeding out portion of cartridge 1. These rollers 2, 3 cooperatively rotate by means of belt 4 and contact with front ones of the notes A whereby the front notes are driven downward by using a pressure force provided by a spring plate 6 engaged with the roller 2 so that a a driven front note is sandwiched between the roller 2 and the roller 5 and pulled from cartridge 1.

In the event that double notes are driven by the two rollers 2 and 3 to be fed out, a friction force is applied to a behind surface of the double notes by the spring plate 6 while a moving force is applied to the front surface of the double notes by the rubber roller 2, so that only the front note is moved to the nip between rollers 2 and 3 and dispensed. The reference numeral 7 designates a supporting plate for supporting the stored notes A.

It will be understood from the foregoing description that in order to feed the stored notes A properly and prevent any double notes from being dispensed out, the spring plate 6 must be engaged with the feeding out rubber roller 2 with a constant contact pressure. In fact, the feeding out rubber roller 2 will be worn out after a prolonged use, so that the above-mentioned contact pressure will be slightly changed resulting in unstable note feeding. Accordingly, periodic maintenance is required for adjusting a constant pressure by unscrewing a fixing screw 9 and moving the spring plate 6 in a direction toward roller 2 along a mounting frame 8 and then rescrewing screw 9.

It is therefore an object of the invention to provide a note feeding device in which a spring plate is automatically adjusted to follow a feeding out roller as it wears down so as to keep a constant contact pressure so that maintenance service for adjusting the contact pressure is unnecessary.

In one embodiment of this invention, there is provided a note feeding device comprising a cartridge for storing notes to be fed out through a feeding portion, a feeding roller disposed at the feeding portion of the cartridge to contact a front surface of the stored notes, a spring plate disposed opposite to the feeding roller with respect to a note dispensed from the cartridge, a reciprocating member for supporting the spring plate and for moving the spring plate in the direction to contact the feeding roller, and a biasing member for pushing the reciprocating member toward the feeding roller.

Other objects and advantages of the invention will be more readily understood from the following detailed description of the invention which is provided in connection with the accompanying drawings.

DETAILED DESCRIPTION OF THE INVENTION

Figure 1:
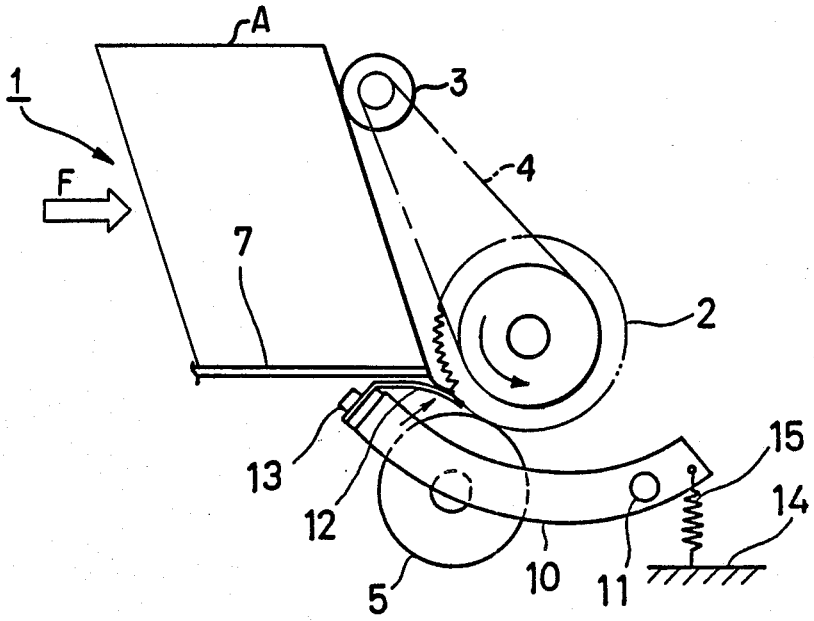
FIG. 1 is a functional view showing a preferred embodiment of a note feeding device in accordance with the invention.
Figure 2:
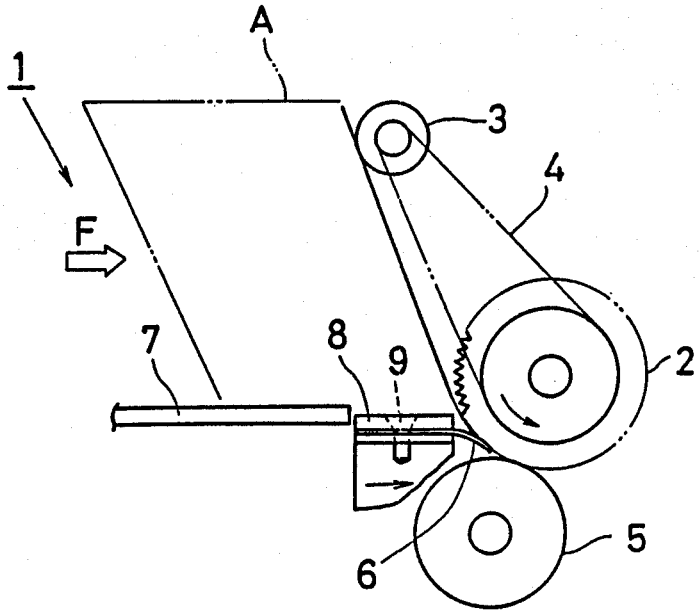
FIG. 2 (PRIOR ART)
FIG. 2 is a functional view explaining the construction of a conventional note feeding device.

Referring now to FIG. 1, there is shown a note feeding device in accordance with one embodiment of this invention. The note feeding device includes a recriprocal swing lever 10 which is supported by a supporting member 11 for recriprocal movement so that its free end is biassed toward feeding out rubber roller 2, a spring plate 12 which is fixed on the free end of the lever 10 by a fixing screw 13, a biassing spring 15 which pulls the other end of the lever 10 towards a stationary frame 14 so as to bring the spring plate 12 toward and into contact with a surface of the rubber roller 2 by which the spring plate 12 is able to contact with the feeding out roller 2 at the surface thereof under a constant contact pressure by the spring 15. Since the other construction of the feeding device of this invention is the same as the construction of the device shown in FIG. 2, a further explanation of its construction will be omitted for simplification.

As the peripheral surface of the feeding out rubber roller 2 shrinks as it is worn down after a prolonged use, the swing lever 10 swings about supporting member 11 by the biassing spring 15 to maintain the spring plate 12 in contact with the feeding out rubber roller 2 to compensate for the worn surface of the roller 2 so that the contact pressure by the spring plate 2 is kept at a desired constant pressure. Thus, in spite of being worn down, the rubber roller 2, in combination with spring plate 12, is adapted to apply a constant pressure for feeding out the stored notes. Plate 12 also properly applies a friction force behind the fed out notes to prevent the feeding of double notes from cartridge 1. Accordingly, in the event that two notes are removed by roller 2 simultaneously, a proper friction force is applied to the behind note, so that the behind note is prevented from being fed out with the leading note.

Although an embodiment of this invention has been shown and described, the drawings and description are not limiting of the invention as many modification can be made without departing of the spirit and scope of the invention. Accordingly, the invention is not limited by the foregoing description, but is only limited by the scope of the claims appended hereto.

I claim:

1. A note feeding device comprising:

a cartridge for storing notes to be fed out through a feeding out portion thereof, said cartridge including a support surface at said feeding out portion on which stored notes are edgewise stacked for feed out;

a feeding roller disposed at said feeding out portion of the cartridge for contacting a front surface of the stored notes to remove notes from said support surface of said cartridge, said cartridge providing a biasing force which biases said notes toward said feeding out portion and said feeding roller, a spring plate separate from said cartridge and disposed opposite to and in direct contact with said feeding roller, a fed note passing from said support surface of said cartridge between said feeding roller and spring plate, said spring plate edgewise contacting fed notes and preventing the feeding of double notes from said cartridge by stopping the feeding from said cartridge of a note behind a note in contact with said feeding roller, a lever having one end to which said spring plate is connected for moving it in a direction of contacting said feeding roller, said lever being rotatable about a fixed pivot point, and a biassing member for biassing another end of said lever so that it causes said spring plate to move in said direction toward said feeding roller to keep said spring plate in contact therewith.

* * * * *